US005927581A

United States Patent [19]

Reddy et al.

[11] Patent Number: 5,927,581

[45] Date of Patent: Jul. 27, 1999

[54] CONVERTIBLE CARRIER

[76] Inventors: James P. Reddy, 430 Chestnut St., Lynn, Mass. 01902; Christopher S. Eaton, 139 Timber Swamp Rd., Hampton, N.H. 03842

[21] Appl. No.: 08/899,064

[22] Filed: Jul. 22, 1997

[51] Int. Cl.[6] ..... A45F 4/02; A45F 3/04

[52] U.S. Cl. ..... 224/578; 224/153; 224/608; 224/645; 224/655; 224/919

[58] Field of Search ..... 224/153, 578, 224/579, 600, 607, 608, 610, 614, 616, 617, 627, 645, 650, 652, 653, 654, 655, 657, 919, 236; 206/315.1, 315.9; D3/215, 216, 217, 257

[56] References Cited

U.S. PATENT DOCUMENTS

| | | | |
|---|---|---|---|
| 294,622 | 3/1884 | Honinger | 224/578 |
| D. 318,567 | 7/1991 | Smith . | |
| D. 335,956 | 6/1993 | Lucas . | |
| D. 339,915 | 10/1993 | Lucas . | |
| D. 346,273 | 4/1994 | Lucas . | |
| D. 365,443 | 12/1995 | Wu . | |
| D. 373,472 | 9/1996 | Eaton et al. . | |
| D. 375,626 | 11/1996 | Eaton et al. | D3/257 |
| 1,370,636 | 3/1921 | Dwyer | 224/610 |
| 2,324,194 | 7/1943 | Campiglia | 224/236 |
| 4,510,982 | 4/1985 | Sangroni . | |
| 4,810,102 | 3/1989 | Norton | 224/578 |
| 4,856,570 | 8/1989 | Rushing et al. | 224/153 |
| 5,265,784 | 11/1993 | Gregory . | |
| 5,431,317 | 7/1995 | Kliot | 224/578 |
| 5,577,652 | 11/1996 | Cooper | 224/578 |

*Primary Examiner*—Gregory M. Vidovich
*Attorney, Agent, or Firm*—O'Connell Law Firm

[57] ABSTRACT

A carrier for sports balls and similar articles that is mutually convertible between a back pack and a shoulder bag without the addition or subtraction of any element. The carrier includes a primary bag comprised of a flexible shell of material with an exterior surface that encloses an open inner volume of sufficient size for retaining a sports ball. Upper central, lower central, first lateral, and second lateral coupling elements are affixed to the exterior surface of the primary bag. An elongated and flexible strap with a first end with a selectively disengagable first attaching mechanism, a second end with a selectively disengagable second attaching mechanism, and a body portion couples to the primary bag at two or more of the coupling elements depending on the form that the carrier is to be used. The convertible carrier may be employed as a shoulder bag with the first end of the strap coupled to the primary bag at the upper central coupling element and the second end of the flexible strap coupled to primary bag at the lower central coupling element, and the convertible carrier alternatively may be employed as a backpack without the addition or subtraction of any element with the first end of the flexible strap coupled to the primary bag at the first lateral coupling element, the second end of the flexible strap coupled to the primary bag at the second lateral coupling element, and the body portion of the flexible strap coupled to the primary bag at the upper central coupling element substantially to bisect the flexible strap into a first shoulder strap and a second shoulder strap.

15 Claims, 3 Drawing Sheets

CONVERTIBLE CARRIER

FIELD OF THE INVENTION

The present invention relates generally to articles carried by a person. More particularly, it relates to a carrier for sports balls and similar articles that is mutually convertible between a backpack and a shoulder bag without the addition or subtraction of any element.

BACKGROUND OF THE INVENTION

Carrying a sports ball can be difficult, particularly when the ball is a large one such as a basketball. Undoubtedly, one can recall at least one instance of seeing a youth walking to or from a basketball court while wrestling to carry a bulky basketball. Naturally, the problem is exacerbated when the person attempts to carry personal belongings such as keys or a wallet in addition to the ball. Such a person's dropping of the ball could lead to a number of repercussions of varying severity. At a minimum, the person must bend over and pick the ball up. However, the person could be forced to chase a ball if it begins to roll, and this could lead to losing the ball or even to being hit a passing car or truck.

Far more difficult and dangerous than carrying a basketball while walking is doing so while riding a bicycle where the risks already inherent in riding a bicycle are compounded by a rider's loss of the effective use of the arm that is needed to carry the ball. The rider's ability to control and steer the bicycle are diminished significantly as is the rider's ability to respond to emergency situations. Coupling these disadvantages with the havoc that could result by a basketball's slipping from a rider's grip makes it clear that attempting to carry a loose ball while riding a bicycle is less than desirable.

Obviously, a variety of devices could be used to carry a sports ball. For example, one could toss the ball in a shoulder bag, or one could squeeze the ball into a back pack. Between the two, the shoulder bag might be considered to be better for those on foot due to its ready accessibility and the freedom of movement that it permits a user. On the other hand, the back pack might be considered to be better for those riding a bicycle because it would maintain itself and the ball in a safe, secure, and unobtrusive position.

However, traditional back packs and shoulder bags suffer from a number of disadvantages relative to carrying a sports ball such as a basketball. For example, neither device is particularly sized and shaped to carry such a ball; most shoulder bags are too bulky and cumbersome, and most back packs are too small to permit an easy insertion and removal of a ball. Furthermore, both devices leave one either with just one option relative to the type of carrying device available or with the expense of procuring both types of carrying devices. Further still, when a user seeks to carry only a sports ball with a few small personal effects such as a wallet or keys, most traditional back packs and shoulder bags include a significant amount of unnecessary material, size, and weight.

With the foregoing in mind, it becomes apparent that there is a need in the art for a compact carrier for sports balls and similar articles that is mutually convertible between a back pack and a shoulder bag.

SUMMARY OF THE INVENTION

Advantageously, a principal object of the present invention is to provide a carrier for sports balls and similar articles that is mutually convertible between a back pack and a shoulder bag.

Another object of the invention is to provide a carrier that is mutually convertible between a back pack and a shoulder bag without requiring the addition or subtraction of any element.

A further object of the invention is to provide a convertible carrier for sports balls that is compact in size.

An additional object of the invention is to render the transportation of sports balls a safer and more convenient task.

Still another object of the invention is to provide a convertible carrier for sports balls that is durable in use and efficient and economical in manufacture whereby a high-quality device may be produced and sold at a reasonable price.

From this specification and the accompanying drawings, these and other objects and advantages of the present invention will become obvious to those skilled in the art.

In carrying out the aforementioned objects, the invention may assume a number of forms. In a basic form, the invention includes a flexible shell of material that forms a primary bag with an open inner volume of sufficient size for retaining a sports ball enclosed therein. The convertible carrier should have at least three coupling elements affixed to the primary bag's exterior surface, but it may be most advantageous to affix four coupling elements. An elongate and flexible strap with a first end with a selectively disengagable first attaching mechanism, a second end with a second attaching mechanism that may be selectively disengagable, and a body portion couples to the primary bag at two or more coupling elements to enable a user to carry the convertible carrier.

It may be preferred to provide an air-and-light permeable window such as a mesh screen in the flexible shell. The mesh screen permits air to ventilate the open inner volume for such purposes as drying a contained sports ball. It also permits a user to identify a contained sports ball visually. Also, substantially an entire top of the flexible shell of the primary bag may be comprised of a generally oval flap top that opens about a hinge end of the flap top. The flap top may be maintained in a closed position by a closure means such as a zipper. When the flap top is opened, the convertible carrier is rendered effectively topless thereby permitting an easy insertion and removal of a sports ball. When the flap top is closed, the sports ball is retained safely and securely. Economy of manufacture may be achieved most advantageously by constructing the primary bag of two mutually-matingly-coupled hourglass-shaped strips of flexible material. The invention may be still more useful with a cylindrical sack affixed to the exterior surface of the primary bag for retaining a beverage container and with a pocket with a protective flap attached to the back of the primary bag. Furthermore, the primary bag may function as a most compact and light carrier for a basketball if it is constructed with an open inner volume that is generally spherical with a diameter of greater than about 9.5 inches and less than about 14 inches.

In presently preferred embodiments of the invention, each of the first, second, and third coupling elements is comprised of a ring with an opening, and each of the first and second attaching mechanisms of the elongated strap is comprised of a clip fixed to a generally rectangular joint with a loop of the elongated strap passed through the rectangular joint. It is preferred that a first coupling element be affixed to a first side of the primary bag at substantially an even height with a second coupling element that is fixed to an opposite side of the primary bag while a third coupling element is affixed to the top of the primary bag. Furthermore, the ring of at least the third coupling element preferably should have an opening that is sufficiently large for allowing an entire attaching mechanism to pass therethrough.

Ease and effectiveness of converting the carrier between back pack and shoulder bag forms may be best served by including a length adjustment mechanism for the elongated strap in the form of an adjustably-sized reverse loop with a slidable adjusting member. With this, the elongated strap may be adjusted in length from a length that is sufficiently short for allowing the invention to be employed as a shoulder bag to a length that is sufficiently long for forming the first shoulder strap and the second shoulder strap of the back pack.

The foregoing discussion broadly outlines the more important features of the invention to enable a better understanding of the detailed description that follows and to instill a better appreciation of the inventors' contribution to the art. Before an embodiment of the invention is explained in detail, it must be made clear that the following details of construction, descriptions of geometry, and illustrations of inventive concepts are mere examples of possible manifestations of the invention

DETAILED DESCRIPTION OF A PREFERRED EMBODIMENT

Figure 1:
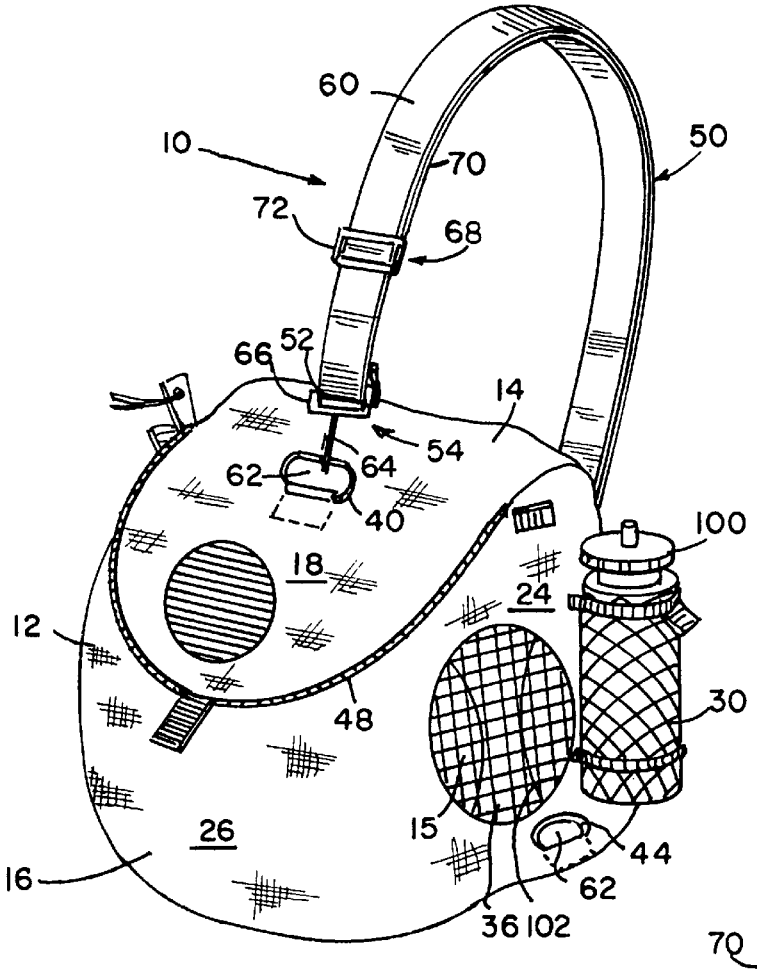
FIG. 1 is a perspective view of a convertible carrier for sports balls and similar articles embodying the present invention and shown adapted for use as a shoulder bag.
Figure 2:
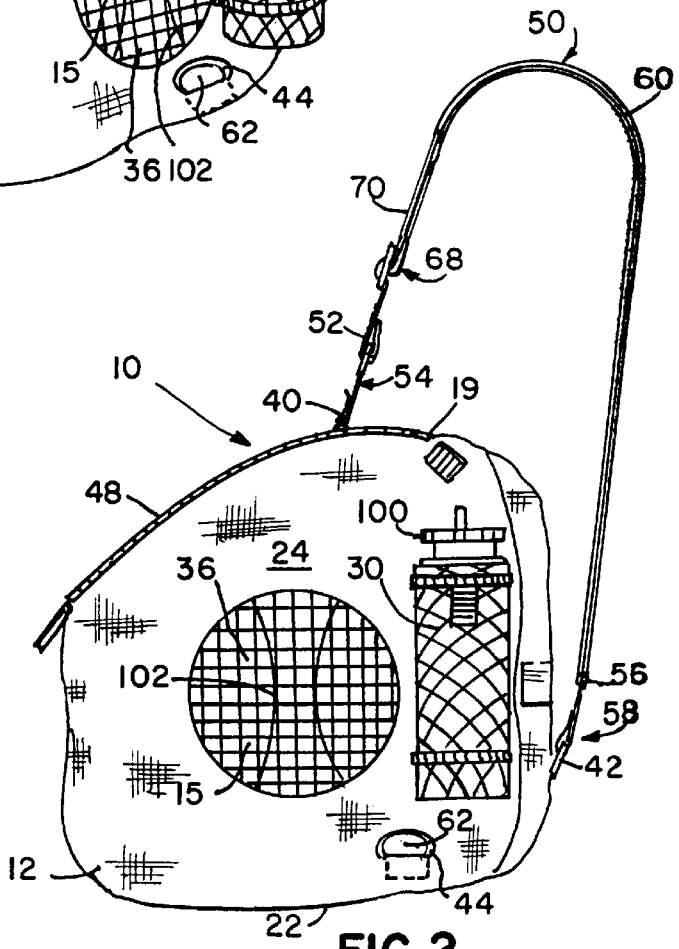
FIG. 2 is a view in side elevation of the convertible carrier of FIG. 1.
Figure 3:
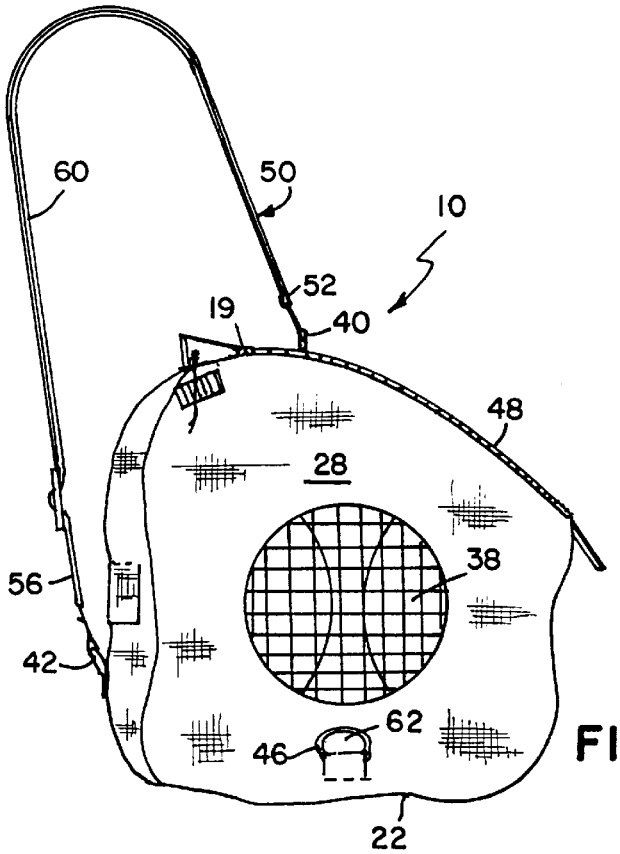
FIG. 3 is a view in side elevation of an opposite side of the convertible carrier of FIG. 1.
Figure 4:
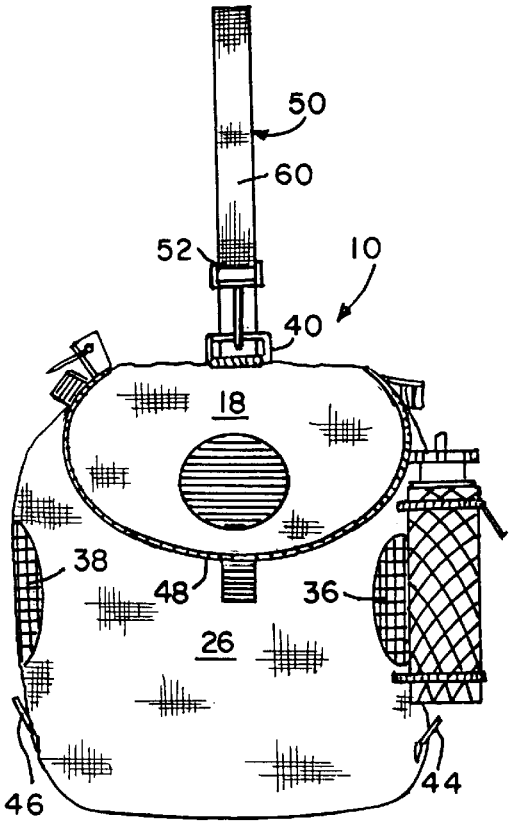
FIG. 4 is a view in front elevation of the convertible carrier of FIG. 1.
Figure 5:
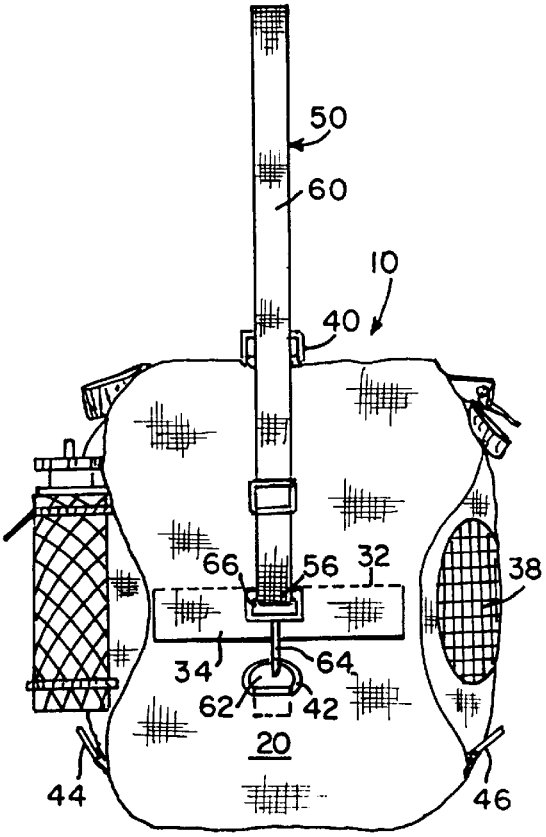
FIG. 5 is a view in rear elevation of the convertible carrier of FIG. 1.

Referring more particularly to the drawings, FIGS. 1 through 6 show a particularly preferred embodiment of the present invention for a convertible carrier for sports balls. In each of the figures, the convertible carrier is indicated generally at 10. The convertible carrier 10 includes a primary bag 12. The primary bag 12 is formed of a first hourglass-shaped strip of flexible material 14 that is mutually-matingly coupled with a second hourglass-shaped strip of flexible material 16. As the figures show, the first hourglass-shaped strip of material 14 is folded so that its first bulb comprises a generally oval flap top portion 18 of the primary bag 12, its middle portion forms a back 20 of the primary bag 12, and its second bulb comprises a bottom 22 of the primary bag 12. The second hourglass-shaped strip of material 16 is folded to form a first side 24 of the primary bag 12, a front 26 of the bag 12, and a second side 28 of the primary bag 12. With this, the first and second hourglass-shaped strips of material 14 and 16 together form the primary bag 12 and enclose a generally spherical open inner volume 15.

Substantially the entire top portion 18 of the primary bag 12 is selectively maintained in a closed position by a zipper closure means 48. Under this arrangement, when the zipper closure means 48 is unzipped to allow the top flap portion 18 to open about a hinge end 19 of the flap portion 18, the primary bag 12 is rendered effectively topless whereby a user can insert and remove a sports ball such as a basketball quickly and easily. A cylindrical sack 30 is affixed to the first side 24 of the primary bag 12 for retaining a beverage container 100, and a pocket 32 with a protective flap 34 is sewn into the back 20 of the primary bag 12 for retaining personal effects such as keys or a wallet (not shown). First and second nylon mesh screen windows 36 and 38 are included in the first and second sides 24 and 28 of the primary bag 12 respectively to allow air into and out of the open inner volume 15 and to allow a user to identify a sports ball 102 such as a standard-sized basketball that is contained within the open inner volume 15.

The primary bag 12 of the convertible carrier 10 has four ring-shaped coupling elements affixed thereto: an upper central coupling element 40 is affixed to the middle of the top portion 18 of the bag 12, a lower central coupling element 42 is affixed to the middle of the back 20 of the bag 12, a first lateral coupling element 44 is affixed to the first side 24 of the bag 12 at a given height, and a second lateral coupling element 46 is affixed to the second side 28 of the bag 12 at a height even with the height at which the first lateral coupling element 46 is affixed. An elongated strap 50 has a first end 52 that attaches to the primary bag 12 by a first selectively disengagable attaching mechanism 54, a second end 56 that attaches to the primary bag 12 by a second selectively disengagable attaching mechanism 58, and a body portion 60. Each coupling element 40, 42, 44, and 46 has an opening 62 therein of a given size, and at least the upper central coupling element 40 has an opening 62 that is sufficiently large for allowing an entire attaching mechanism 54 and 58 to pass therethrough. Each attaching mechanism 54 and 58 is comprised of a clip 64 that is fixed to a rectangular joint 66. The elongated strap 50 has a length adjustment mechanism 68 comprised of a reverse loop 70 where it doubles over upon itself and a slidable adjusting member 72.

Figure 6:
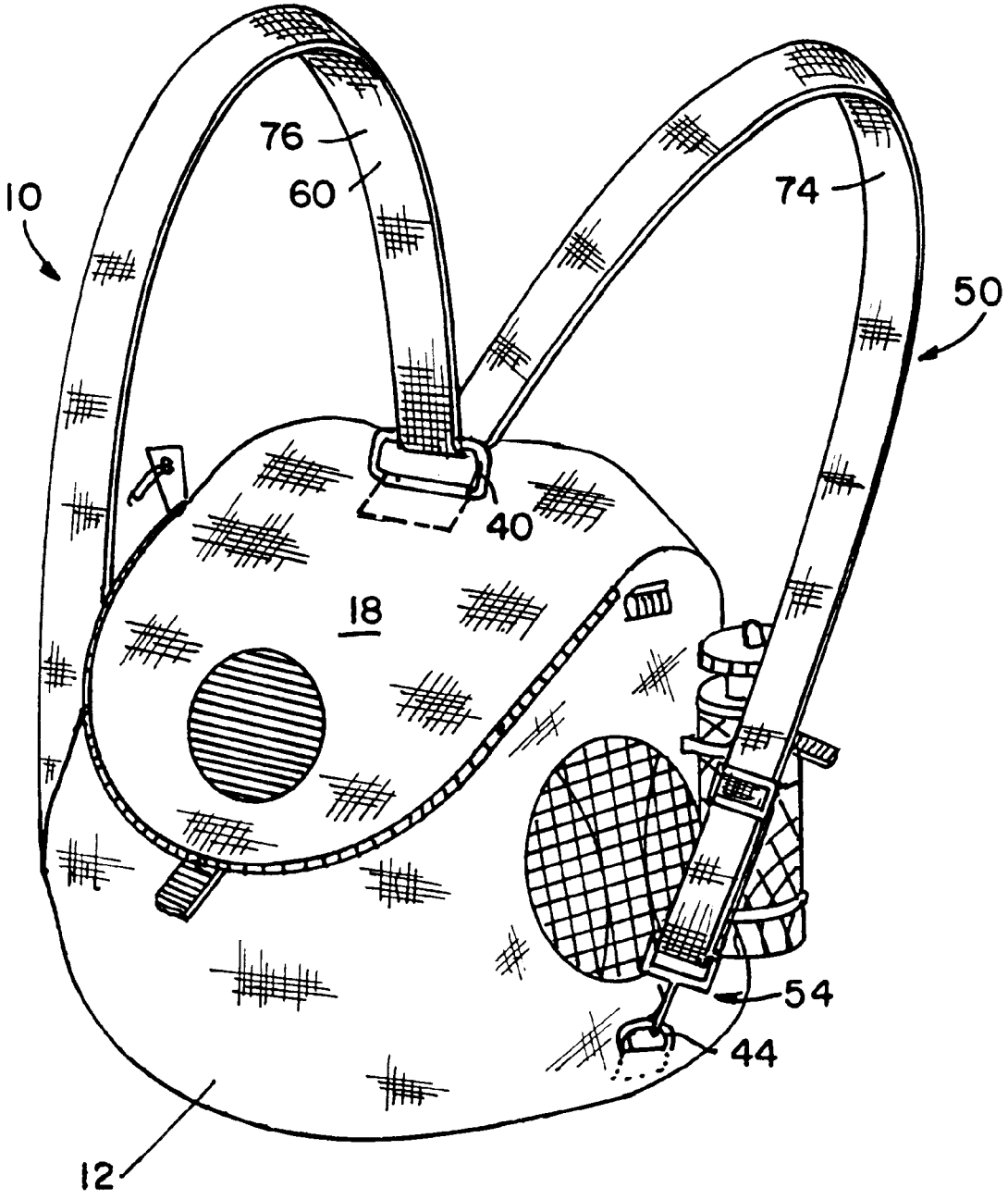
FIG. 6 is a perspective view of a convertible carrier for sports balls and similar articles embodying the present invention shown adapted for use as a backpack.

With the invention's mutual convertibility, a user can employ the convertible carrier 10 in shoulder-bag form as is illustrated in FIGS. 1 through 5 or in back-pack form as is shown in FIG. 6. To take advantage of the shoulder-bag form of the invention, one can use the first selectively disengagable attaching mechanism 54 to connect the first end 52 of the elongated strap 50 to the upper central coupling element 40, and one can use the second selectively disengagable attaching mechanism 58 to connect the second end 56 of the elongated strap 50 to the lower central coupling element 42. The convertible carrier 10 alternatively may be employed as a back pack without the addition or subtraction of any element by disconnecting the first and second selectively disengagable attaching mechanisms 54 and 58, connecting the first selectively disengagable attaching mechanism 54 to the first lateral coupling element 44, passing the second selectively disengagable attaching mechanism 58 through the upper central coupling element 40, and connecting the second selectively disengagable attaching mechanism 58 to the second lateral coupling element 46. As FIG. 6 shows, performing these steps substantially bisects the flexible strap 50 into a first shoulder strap 74 and a second shoulder strap 76.

It has been discovered that a most ideal convertible carrier 10 will have an elongated strap 50 that is relatively wide so that the convertible carrier 10 may be comfortably worn either as a back pack or as a shoulder bag without the elongated strap 50 digging into a wearer's body. For example, the ideal elongated strap 50 will be at least about two inches wide. One may note that such a wide elongated strap 50 inevitably will require coupling elements 54 and 58 with rectangular joints 66 that are somewhat wider than two inches. For example, in a presently-preferred embodiment with a two inch wide strap, the rectangular joints 66 are about two and one-quarter inches wide. Consequently, for the invention to be mutually convertible when it has an elongated strap 50 and coupling elements 54 and 58 of such widths, it has been discovered that at least the upper central coupling element 40 of the four coupling elements 40, 42, 44, 46 must have a uniquely large opening 62 therein that is effectively greater than about two inches wide. It has been found that an opening 62 that is two inches wide or greater will permit one to manipulate a coupling element 54 or 58 with a two and one-quarter inch wide rectangular joint 66 therethrough, and smaller openings 62 make practicing the mutual convertibility of the invention unduly difficult or impossible.

As one might expect and as the drawings show, as one converts the carrier 10 between back pack and shoulder bag forms, a need arises to employ the length adjustment mechanism 68 to suit the particular application. For example, one will see in FIGS. 1–5 where the carrier 10 is shown as a shoulder bag that the adjustment mechanism 68 has been employed to shorten the elongated strap 50 to nearly its shortest length. However, when one seeks to use the carrier 10 as a back pack as in FIG. 6, it is likely that the elongated strap 50 should be lengthened sufficiently to create adequately sized first and second shoulder straps 74 and 76.

From the foregoing, it is apparent that the present invention provides many advantages. For example, by its unique construction, the invention is mutually convertible between a back pack and a shoulder bag without the addition or subtraction of any element. Furthermore, the carrier 10 is particularly configured and sized to carry a sports ball such as a basketball. As a result, it is less bulky and obtrusive than prior art devices. Further still, the mutually-matingly coupled hourglass-shaped flexible strips 14 and 16 enable the convertible carrier 10 to be manufactured economically and efficiently such that a high quality device may be produced and sold at a reasonable price. Most importantly, the convertibility of the carrier 10 ultimately makes the transportation of sports balls a safer and more convenient task. One may note that the enhanced safety provided by the convertible carrier 10 is particularly prevalent when it is used in back pack form because it provides even weight distribution in an efficient and unobtrusive manner.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

We claim as protected by United States Letters Patent:

1. A convertible carrier for sports balls, the carrier comprising:

a primary bag comprised of a flexible shell of material with an exterior surface and an open inner volume enclosed within the flexible shell of sufficient size for retaining a sports ball;

a first coupling element affixed to the exterior surface of the primary bag;

a second coupling element affixed to the exterior surface of the primary bag, a third coupling element affixed to the exterior surface of the primary bag;

a fourth coupling element affixed to the exterior surface of the primary bag;

an elongated and flexible strap with a first end with a selectively disengagable first attaching mechanism for attaching the strap to a coupling element, a second end with a second attaching mechanism for attaching the strap to a coupling element, and a body portion;

wherein the convertible carrier may be employed as a shoulder bag with the first end of the flexible strap coupled to the primary bag at the first coupling element and the second end of the flexible strap coupled to the primary bag at the second coupling element;

wherein the convertible carrier alternatively may be employed as a backpack without the addition or subtraction of any element with the first end of the flexible strap coupled to the primary bag at the third coupling element, the second end of the flexible strap coupled to the primary bag at the fourth coupling element, and the body portion of the flexible strap coupled to the primary bag at the first coupling element substantially to bisect the flexible strap into a first shoulder strap and a second shoulder strap; and wherein each of the first, second, third and fourth coupling elements is comprised of a ring with an opening and each of the first and second attaching mechanisms of the elongated strap is comprised of a clip fixed to a generally rectangular joint with a loop of the elongated strap passed through the rectangular joint, wherein the third coupling element is affixed to a first side of the primary bag at substantially an even height with the fourth coupling element that is fixed to an opposite side of the primary bag while the first coupling element is affixed to a flap top of the primary bag and the second coupling element is fixed to a lower central portion of the exterior surface of the primary bag, and wherein the ring of at least the first coupling element has an opening that is sufficiently large for allowing an entire one of the attaching mechanisms to pass therethrough whereby the convertible carrier may be converted from the shoulder bag with the first end of the flexible strap coupled to the primary bag at the first coupling element and the second end of the flexible strap coupled to the primary bag at the second coupling element to the backpack without the addition or subtraction of any element by disconnecting the first end of the strap from the first coupling element, disconnecting the second end of the strap from the second coupling element, connecting the first end of the strap to the third coupling element, passing the second end of the strap through the first coupling element, and connecting the second end of the strap to the fourth coupling element substantially to bisect the flexible strap into the first shoulder strap and the second shoulder strap.

2. The convertible carrier of claim 1 further comprising at least one air-and-light-permeable window in the flexible shell of the primary bag for permitting ventilation of the open inner volume of the primary bag and for permitting visual identification of a sports ball contained in the open inner volume.

3. The convertible carrier of claim 2 wherein the window is comprised of a mesh screen.

4. The convertible carrier of claim 1 further comprising a cylindrical sack affixed to the exterior surface of the primary bag for retaining a beverage container and a pocket with a protective flap attached to a back of the primary bag.

5. The convertible carrier of claim 1 wherein the open inner volume of the primary bag is generally spherical and has a diameter of greater than about 9.5 inches and less than about 14 inches whereby the carrier can retain a basketball while remaining compact and light.

6. The convertible carrier of claim 1 wherein the elongated strap has a width of at least about two inches, each of the first and second attaching mechanisms is generally rigid, the rectangular joint of each of the first and second attaching mechanisms has a width of at least about two and one-quarter inches, and the opening of at least the first coupling element is effectively greater than about two inches whereby the convertible carrier retains mutual convertibility while the elongated strap is sufficiently wide for preventing the elongated strap from digging into a wearer.

7. The convertible carrier of claim 1 wherein the elongated strap has a length adjustment mechanism comprised of a slidable adjusting member operably associated with the loop of either the first or second attaching mechanisms of the elongated strap for adjusting a size of that loop whereby the elongated strap may be adjusted in length from a length that is sufficiently short for allowing the convertible carrier to be employed as the shoulder bag to a length that is sufficiently long for forming the first shoulder strap and the second shoulder strap.

8. A convertible carrier for sports balls, the carrier comprising:

a primary bag comprised of a flexible shell of material with an exterior surface and enclosing an open inner volume of sufficient size for retaining a sports ball;

an upper central coupling element affixed to an upper central portion of the exterior surface of the primary bag;

a lower central coupling element affixed to a lower central portion of the exterior surface of the primary bag;

a first lateral coupling element affixed to a lateral portion of the exterior surface of the primary bag;

a second lateral coupling element affixed to a lateral portion of the exterior surface of the primary bag generally opposite the first lateral coupling element;

an elongated and flexible strap with a first end with a selectively disengagable first attaching mechanism for attaching the strap to a coupling element, a second end with a selectively disengagable second attaching mechanism for attaching the strap to a coupling element, and a body portion;

wherein substantially an entire top of the flexible shell of the primary bag comprises a generally oval flap top that opens about a hinge end of the flap top, and the convertible carrier further comprising a closure means for selectively maintaining the flap top in a closed position whereby the flap top may be opened to render the bag effectively topless thereby permitting easy insertion and removal of a sports ball and the flap top may be closed to ensure a secure retaining of the sports ball within the open inner volume of the primary bag;

wherein the flexible shell of the primary bag comprises a first hourglass-shaped strip of flexible material folded so that a first bulb of the first strip forms a bottom of the primary bag, a second bulb of the first strip forms the generally oval flap top of the primary bag, and a middle portion of the first strip forms a back of the primary bag and the first hourglass-shaped strip of flexible material is mutually matingly coupled with a second hourglass-shaped strip of flexible material that is folded so that a first bulb of the second strip forms a side of the primary bag, a second bulb of the second strip forms an opposite side of the primary bag, and a middle portion of the second strip forms a front of the primary bag;

wherein the convertible carrier may be employed as a shoulder bag with the first end of the strap coupled to the primary bag at the upper central coupling element and the second end of the strap coupled to the primary bag at the lower central coupling element; and wherein the convertible carrier alternatively may be employed as a backpack without the addition or subtraction of any element with the first end of the flexible strap coupled to the primary bag at the first lateral coupling element, the second end of the flexible strap coupled to the primary bag at the second lateral coupling element, and the body portion of the flexible strap coupled to the primary bag at the upper central coupling element substantially to bisect the flexible strap into a first shoulder strap and a second shoulder strap.

9. The convertible carrier of claim 8 further comprising at least one air-and-light-permeable window in the flexible shell of the primary bag for permitting ventilation of the open inner volume of the primary bag and for permitting visual identification of a sports ball contained in the open inner volume of the primary bag.

10. The convertible carrier of claim 9 wherein the window is comprised of a mesh screen.

11. The convertible carrier of claim 8 further comprising a cylindrical sack affixed to the exterior surface of the primary bag for retaining a beverage container and a pocket with a protective flap attached to the back of the primary bag.

12. The convertible carrier of claim 8 wherein the open inner volume of the primary bag is generally spherical and has a diameter of greater than about 9.5 inches and less than about 14 inches whereby the carrier can retain a basketball while remaining compact and light.

13. The convertible carrier of claim 8 wherein each of the upper central, lower central, first lateral, and second lateral coupling elements is comprised of a ring with an opening and each of the first and second attaching mechanisms of the elongated strap is comprised of a clip fixed to a generally rectangular joint with a loop of the elongated strap passed through the rectangular joint, wherein the first lateral coupling element is affixed to the primary bag at substantially an even height with the second lateral coupling element, and wherein the ring of at least the upper central coupling element has an opening that is sufficiently large for allowing an entire one of the attaching mechanisms to pass therethrough whereby the convertible carrier may be converted from the shoulder bag with the first end of the flexible strap coupled to the primary bag at the upper central coupling element and the second end of the flexible strap coupled to the primary bag at the lower central coupling element to the backpack without the addition or subtraction of any element by disconnecting the first and second ends of the elongated strap from the upper and lower central coupling elements respectively, coupling the first end of the strap to the first lateral coupling element, passing the second end of the strap through the upper central coupling element, and connecting the second end of the strap to the second lateral coupling element substantially to bisect the flexible strap into the first shoulder strap and the second shoulder strap.

14. The convertible carrier of claim 13 wherein the elongated strap has a width of at least about two inches, each of the first and second attaching mechanisms is generally rigid, the rectangular joint of each of the first and second attaching mechanisms has a width of at least about two and one-quarter inches, and the opening of at least the upper central coupling element is effectively greater than about two inches whereby the convertible carrier retains mutual convertibility while the elongated strap is sufficiently wide for preventing the elongated strap from digging into a wearer.

15. The convertible carrier of claim 13 wherein the elongated strap has a length adjustment mechanism comprised of a slidable adjusting member operably associated with the loop of either the first or second attaching mechanisms of the elongated strap for adjusting a size of that loop whereby the elongated strap may be adjusted in length from a length that is sufficiently short for allowing the convertible carrier to be employed as the shoulder bag to a length that is sufficiently long for forming the first shoulder strap and the second shoulder strap.

* * * * *